US007131481B2

(12) United States Patent
Varley et al.

(10) Patent No.: US 7,131,481 B2
(45) **Date of Patent: *Nov. 7, 2006**

(54) FLEXIBLE CURTAIN ROLLUP DOOR WITH COMBINATION STIFFENING STRUTS AND WINDLOCKS

(75) Inventors: David A. Varley, Lewistown, PA (US); Richard D. Aiken, Reedsville, PA (US); Raymond A. Clark, State College, PA (US); George Lair, Newton Hamilton, PA (US)

(73) Assignee: Overhead Door Corporation, Lewisville, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/769,156

(22) Filed: Jan. 30, 2004

(65) Prior Publication Data

US 2004/0182024 A1 Sep. 23, 2004

Related U.S. Application Data

(63) Continuation of application No. 10/115,776, filed on Apr. 3, 2002, now Pat. No. 6,722,416.

(51) Int. Cl.
*A47G 5/02* (2006.01)

(52) U.S. Cl. ..... 160/273.1; 160/23.1; 160/133; 160/271; 160/310; 160/349.1; 160/264; 52/2.25; 52/660; 52/656.1; 52/204.1

(58) Field of Classification Search ..... 160/264, 160/270–273.1, 133, 349.1, 310, 23.1; 52/656.1, 52/656.6–656.9, 660–669, 204.1, 210–213, 52/2.25

See application file for complete search history.

(56) References Cited

U.S. PATENT DOCUMENTS

| | | | | |
|---|---|---|---|---|
| 1,033,224 | A | | 7/1912 | Andlauer |
| 1,546,575 | A | | 7/1925 | Emerick |
| 1,694,314 | A | | 12/1928 | Dixson |
| 1,786,054 | A | | 12/1930 | Dixson |
| 3,827,019 | A | * | 7/1974 | Serbu ..... 335/285 |
| 4,230,171 | A | * | 10/1980 | Baker, Sr. ..... 160/84.01 |
| 4,433,711 | A | * | 2/1984 | Lew ..... 160/120 |
| 4,478,268 | A | | 10/1984 | Palmer |
| 4,601,320 | A | | 7/1986 | Taylor |
| 4,771,505 | A | | 9/1988 | Dilich |
| 4,800,946 | A | * | 1/1989 | Rosenoy ..... 160/264 |
| 4,884,617 | A | | 12/1989 | Coenraels |
| 5,056,579 | A | | 10/1991 | Krafutler |

(Continued)

OTHER PUBLICATIONS

Hawley's Condensed Chemical Dictionary, Lewis, 1997, John Wiley & Sons, 13, 811, 812.*

(Continued)

*Primary Examiner*—Jeanette Chapman
(74) *Attorney, Agent, or Firm*—Gardere Wynne Sewell LLP

(57) ABSTRACT

A flexible curtain rollup door includes a drum mounted on a door frame and drivenly connected to an electric right angle gear motor unit. The frame includes opposed channel shaped guide tracks for receiving opposed side edges of a door curtain. Spaced apart elastically deflectable combination curtain stiffening struts and windlock members are secured to the curtain and include opposed windlock parts receivable in the guide tracks and configured, respectively, to provide for releasing only one side edge of the curtain from its guide track. A flexible transverse bottom bar includes plural side by side flexible bags filled with particulate material, secured to the curtain bottom edge and enclosed by a flexible envelope member. The curtain bottom edge includes a stiffener formed of interconnected links.

14 Claims, 10 Drawing Sheets

U.S. PATENT DOCUMENTS 5,058,651 A 10/1991 Ashley et al.
5,141,043 A 8/1992 Kraeutler
5,207,256 A 5/1993 Kraeutler
5,214,885 A * 6/1993 Maas et al. ..... 52/71
5,219,015 A 6/1993 Kraeutler
5,394,926 A 3/1995 Kraeutler
5,477,902 A * 12/1995 Kraeutler ..... 160/84.06
5,526,865 A 6/1996 Coenraets
5,579,820 A 12/1996 LePage et al.
5,632,317 A * 5/1997 Krupke et al. ..... 160/265
5,638,883 A 6/1997 Schulte
6,035,918 A * 3/2000 Kraeutler ..... 160/84.06
6,070,640 A * 6/2000 Miyagawa et al. ..... 160/121.1
6,089,305 A 7/2000 Gruben et al.
6,662,846 B1 * 12/2003 Hanright ..... 160/84.01
6,722,416 B1 * 4/2004 Varley et al. ..... 160/264
6,942,003 B1 * 9/2005 Thompson ..... 160/268.1

OTHER PUBLICATIONS

Dynaco International Curtain Type Door Product Literature and Photoprints (9 pp.), date unknown.

* cited by examiner

FLEXIBLE CURTAIN ROLLUP DOOR WITH COMBINATION STIFFENING STRUTS AND WINDLOCKS

CROSS REFERENCE TO RELATED APPLICATION

This application is a continuation of U.S. patent application Ser. No. 10/115,776, filed Apr. 3, 2002, now U.S. Pat. No. 6,722,416.

BACKGROUND OF THE INVENTION

Rollup type doors are widely used in many applications for forming a closure over an opening in a building. Rollup type doors are typically characterized by flexible curtain-like closure members which are adapted to be wound onto a rotatable drum for moving the door between a closed position and an open position. Flexible curtain rollup doors do, however, require reinforcement to prevent windloads from blowing the curtain out of opposed guide tracks or channels and through the door opening. Such reinforcements may include plural spaced apart windlock members disposed above the curtain edges, a thickened portion of the opposed edges of the curtain or one or more spaced apart laterally extending windbar members disposed adjacent to the door curtain and guided in opposed guide tracks.

However, in many industrial applications of rollup type doors it is also desirable: to provide for releasing the aforementioned windbars or windlocks under impact loads which are often encountered by such doors being impacted by freight-moving vehicles, such as lift trucks, for example. Moreover, such doors are also desirably adapted to release from opposed door edge guides at a predetermined air pressure differential or "windload" to prevent catastrophic failure of the door and its associated support structure. Flexible curtain type doors have been developed which include windbars or windlocks at opposite lateral edges of the door which provide for completely releasing the door from its opposed guides. However, releasing the door at both side edges from the associated guide structure complicates the requirements for reinserting the door curtain in the guide tracks. Still further, certain prior art doors which are provided with side edge windlocks and also are provided with laterally extending reinforcing or stiffening members., often called windbars, are somewhat complicated.

Various other desiderata have been recognized in industrial rollup doors including improvements in the door bottom edge seal, or so called bottom bar, wherein it is desirable to provide weighting structure operable to assist in pulling the door toward a closed position while at the same time configuring the weighting structure so that it will not damage an object upon which the door may inadvertently close.

Still further, it is desirable to provide an uncomplicated and inexpensive design which still meets all of the desiderata and trouble-free operation for rollup type doors. It is to these ends that the present invention has been developed.

SUMMARY OF THE INVENTION

The present invention provides an improved flexible curtain type door and an improved rollup flexible type door, in particular, and wherein the door is operable to maintain a closure over an opening under substantial windloads while also providing for release of the door curtain at one side should forces acting on the curtain be excessive and potentially damaging.

In accordance with one aspect of the invention, a flexible curtain type door is provided with combination curtain stiffening struts or battens and windlocks which are operable to release the curtain along at least one of the curtain side edges from curtain side edge guide structure. In particular, the combination struts and windlocks are preferably operable to release the door curtain at only one lateral side thereof to minimize the requirements of resetting the curtain within the guides while providing sufficient relief from forces acting on the door which would otherwise possibly damage the curtain and/or associated door guide structure.

The present invention also provides an improved curtain and strut guide track section which includes opposed recapture chutes and movable guide track parts which provide guidance for the curtain and strut edges during normal operation of the door but also allow reentry or recapture of the curtain and strut edges if the curtain has been displaced from the guide tracks in either one of opposite directions.

Still further, there is provided a flexible curtain type door, particularly adapted for operation as a rollup door and which includes an improved bottom edge or so-called bottom bar assembly including curtain stiffening members which provide stiffness in opposite directions out of the normal plane of the door curtain but allow deflection in a vertical direction generally in the plane of the door. The invention still further includes a simplified and advantageous motor drive arrangement for rotating a drum on which a door curtain is wound when moving the curtain between open and closed positions.

Those skilled in the art will further appreciate the above-mentioned advantages and superior features of the flexible curtain door of the present invention together with other important aspects thereof upon reading the detailed description which follows in conjunction with the drawings.

DETAILED DESCRIPTION OF PREFERRED EMBODIMENTS

Figure 1:
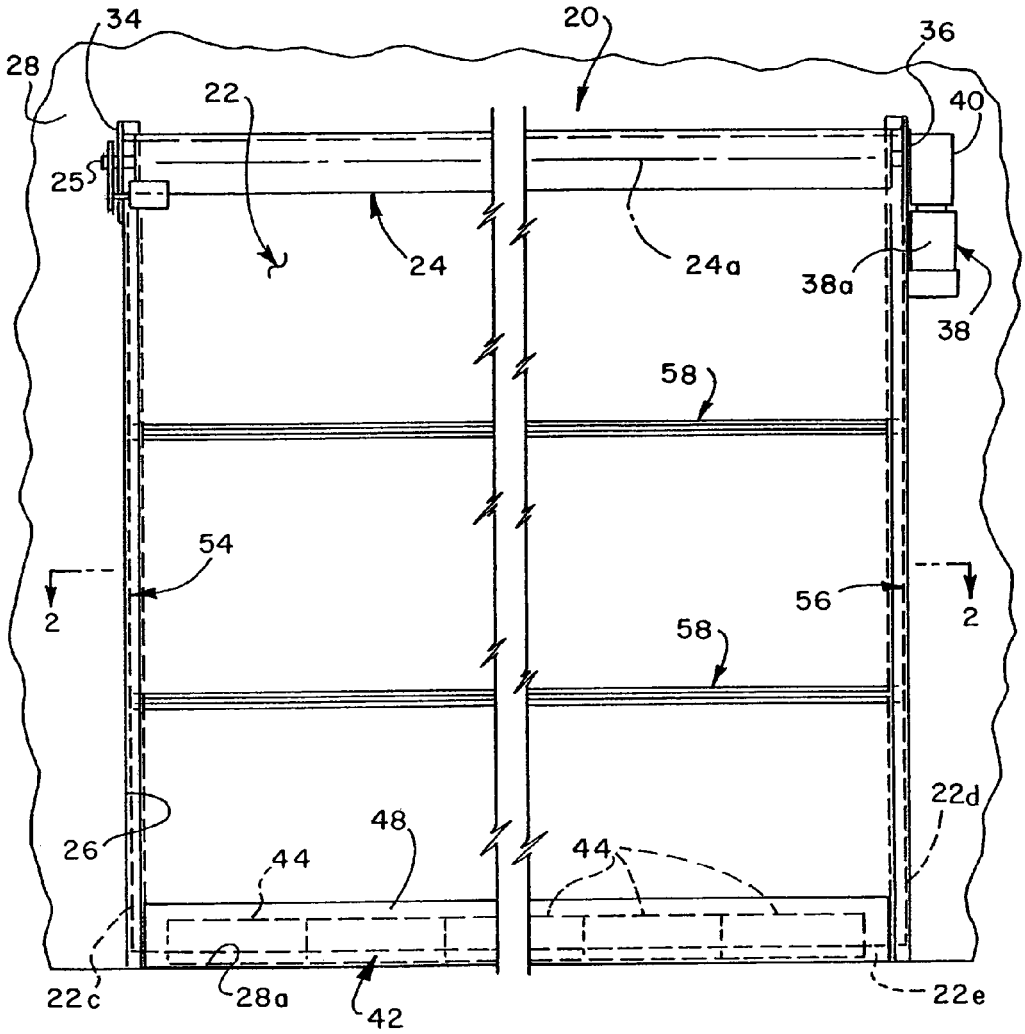
FIG. 1 is a front elevation view of a flexible curtain type door in accordance with the present invention.

In the description which follows like parts are marked throughout the specification and drawing with the same reference numerals, respectively. The drawing figures are not necessarily to scale and certain features may be shown in somewhat generalized form in the interest of clarity and conciseness.

Figure 2:
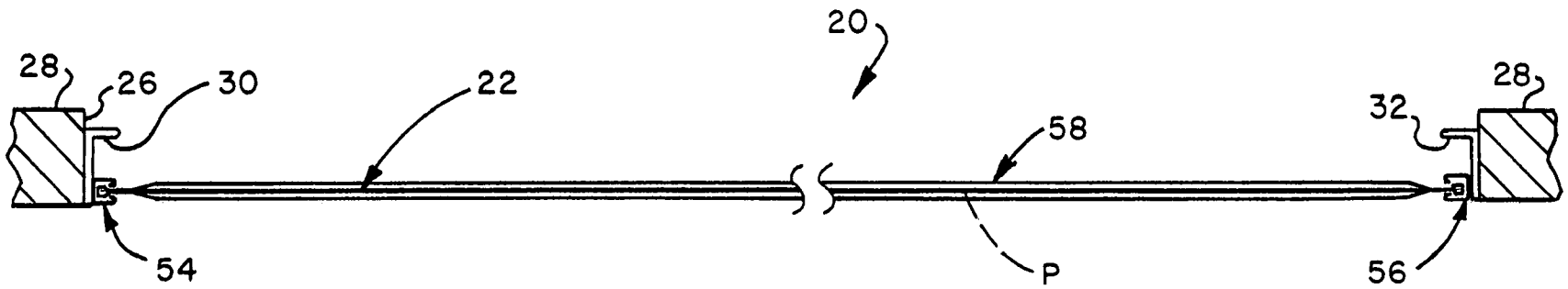
FIG. 2 is a section view taken generally along the line 2—2 of FIG. 1.
Figure 3:
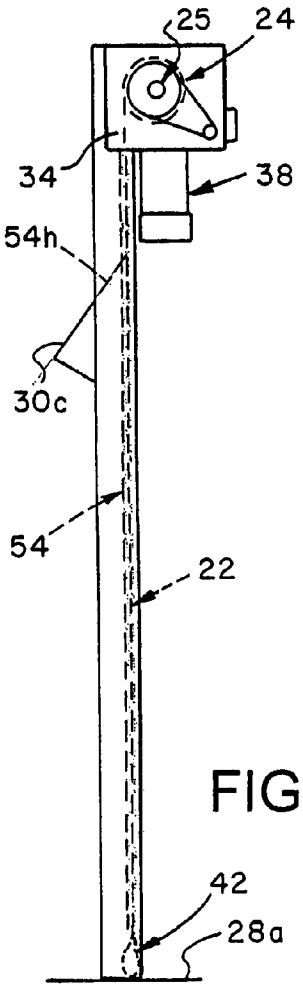
FIG. 3 is a side elevation of the door assembly shown in FIGS. 1 and 2.

Referring to FIGS. 1, 2, and 3, there is illustrated an improved flexible curtain type rollup door assembly in accordance with the invention and generally designated by the numeral 20. The rollup door assembly 20 is characterized by a substantially planar, flexible curtain closure member 22 supported by and adapted to be rolled on and off of a rotatable drum 24 for forming a closure over a door opening 26 formed in a wall 28, see FIGS. 1 and 2.

The door assembly 20 is further characterized by opposed elongated guide track support members 30 and 32, characterized as conventional right angle structural members and which are adapted to fit within the door opening 26, and suitably secured to the wall 28, as shown in FIG. 2. The support members 30 and 32 are adapted to support., respectively, spaced apart headplate members 34 and 36, FIGS. 1, 3, and 4 which are secured to the members 30 and 32 by conventional mechanical fasteners, not shown in FIGS. 1 and 3. The headplate members 34 and 36 are adapted to support the roller or drum 24, which includes an elongated central shaft 25, see FIG. 4, projecting from opposite sides of a drum member 27 and supported in spaced apart bearings 29, one shown in FIG. 4. Bearings 29 are, respectively, suitably secured to the opposed headplate members 34 and 36.

Figure 4:
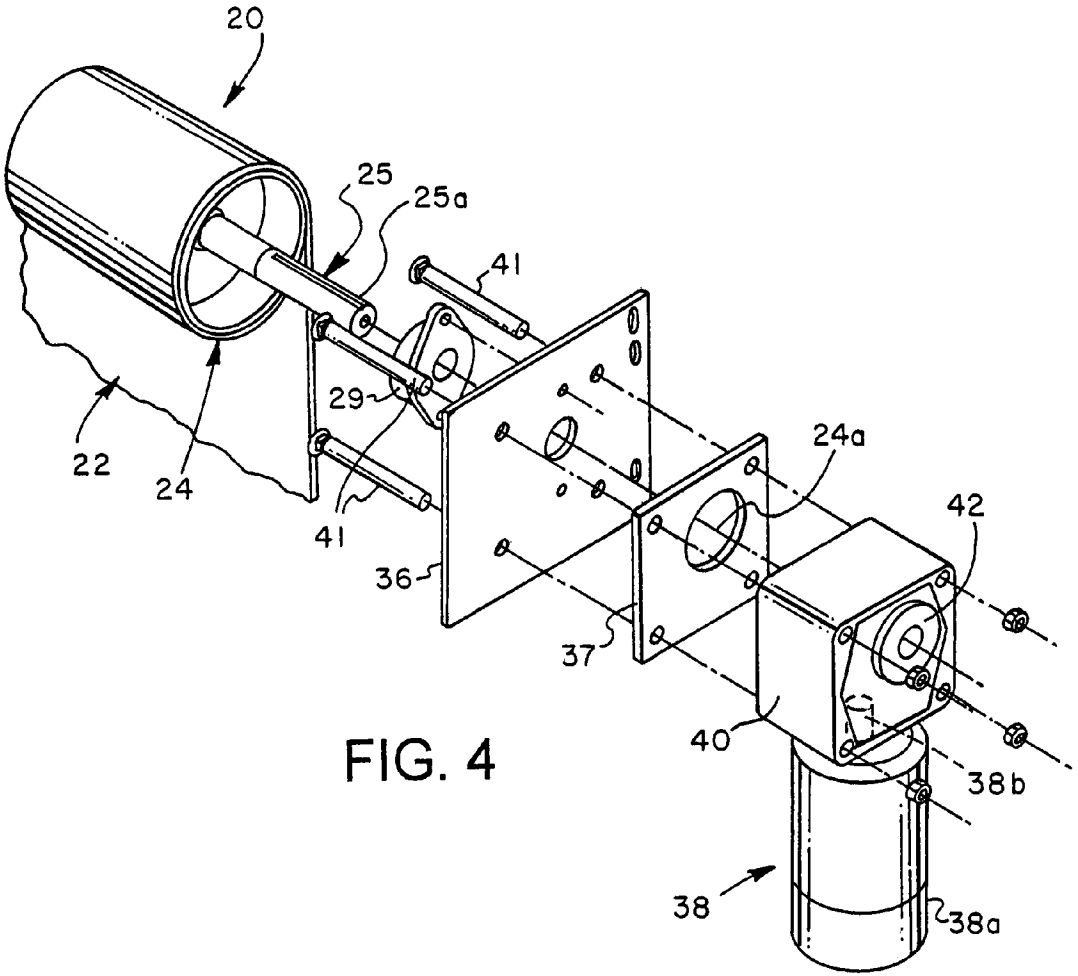
FIG. 4 is an exploded perspective view showing a preferred arrangement of a drive motor and curtain drum for the door assembly of the present invention.

As shown in FIGS. 1, 3, and 4, the door assembly 20 is advantageously provided with a drive motor unit 38 comprising a commercially available electric drive motor 38*a* drivably connected to a right angle gear drive unit 40, FIG. 4. Gear drive unit 40 includes a hollow, rotatable output shaft 42 supported thereon which is adapted to receive the distal end 25*a* of shaft 25 in a suitable driving connection therewith. Drive motor unit 38 is adapted to be mounted on headplate 36 by way of an intermediate mounting plate 37, FIG. 4, and by conventional mechanical fasteners 41, as shown in the exploded perspective view of FIG. 4. One advantage of the commercially available drive motor unit 38 is the compact and reduced space requirement configuration of the motor, as indicated by drawing FIGS. 1, 3, and 4. In other words, by providing a right angle drive between the motor output shaft 38*b* and the axis of rotation 24*a* of the roller or drum 24 and its shaft 25 the space requirements for the drive motor for the door assembly 20 are substantially reduced. One commercial source for the drive motor unit 38 is Sumitomo Machinery Corporation of America as their type SM-Hyponic. Drive motor units 38 of from 0.50 hp to 3.0 hp are suitable for door assemblies 20 of from about five feet to twenty four feet height and four feet to twenty six feet width. The fabric of the curtain 22 is preferably 1.0 to 2.50 millimeter thick polyvinyl chloride with interwoven fabric reinforcement.

Figure 5A:
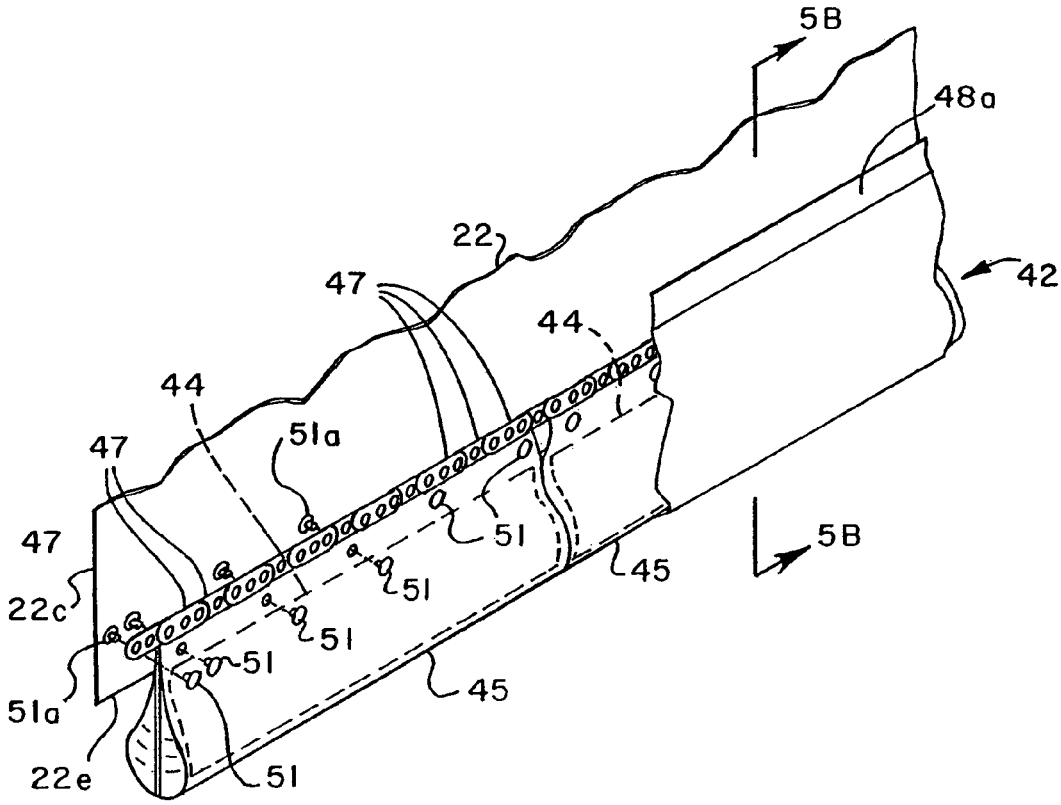
FIG. 5A is a perspective view of a portion of one preferred embodiment of a curtain bottom bar assembly in accordance with the present invention.
Figure 5B:
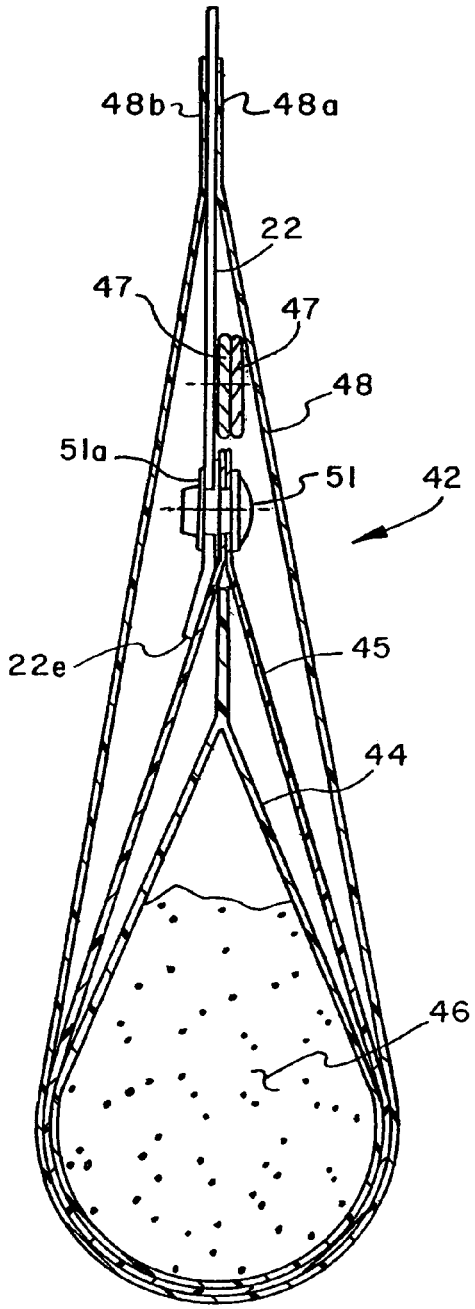
FIG. 5B is a section view taken along the line 5B—5B of FIG. 5A.

Referring further to FIGS. 1, 3, and 5A, the door curtain 22 is provided with a so called soft transverse bottom bar assembly 42, normally operable to form a seal at a floor surface 28*a*, FIG. 1, when the door 20 is in a closed position. The bottom bar assembly 42 is adapted to minimize damage to any object which may be disposed in the doorway when the door curtain 22 is moved to the door closed position. As shown in FIGS. 1, 5A and 5B, the bottom bar assembly 42 is characterized by plural flexible bag-like members 44 mounted side-by-side substantially across the width of the curtain 22, and with adjacent members 44 mounted substantially contiguous with each other. As shown in FIG. 5B, the bottom bar bag members 44 are preferably filled with a particulate material, such as steel shot, welding slag, sand or other relatively dense particulate material, indicated by numeral 46 in FIG. 5B.

Each bag member 44 is also, preferably contained within an outer, flexible envelope member 45 preferably closed by heat sealing, for example, at its opposite ends. Each of the bags 44 and each envelope member 45 may, preferably, be formed of a suitable flexible material, such as the material used for the curtain 22. Each bag and envelope 44, 45 is attached to the curtain 22 adjacent curtain bottom edge 22*e* by fastener means comprising plural spaced apart aluminum rivets 51 and rivet grommets 51*a*, as shown in FIGS. 5A and 5B. In particular, rivets 51 secure the bag envelopes 45 to the curtain 22, as shown.

By providing plural bags 44 mounted side by side across the transverse bottom edge 22*e* of curtain 22, firmness yet flexibility of the bottom bar assembly 42 is provided for conforming to the shape of any obstruction which might be encountered by the bottom bar assembly as the curtain 22 is moved to a closed position. Moreover, provision of plural side-by-side mounted bag members 44 alleviates the tendency for the particulate material 46 to gravitate to one side or the other of the door curtain 22 as might occur if the soft bottom bar assembly 42 was formed with a single bag or receptacle for all of the particulate material 46.

Added protection for the soft bottom bar bags 44 is provided by an outer flexible envelope member 48, FIGS. 1, 5A, and 5B-, which encapsulates the respective bottom bar bag and envelope members 44, 45, as illustrated. The outer envelope 48 may also be formed of the same material as the bag members 44 and/or the curtain 22. Still further, as shown in FIGS. 5A and 5B, the outer envelope 48 is, preferably, also suitably secured to opposite sides of the curtain 22 by a suitable adhesive applied to opposed envelope edge portions 48*a* and 48*b*, for example.

Referring further to FIGS. 5A and 5B, the door curtain 22 is also provided, adjacent its bottom edge 22*e*, with lateral stiffening means comprising plural end to end connected elongated and relatively thin, somewhat elastically deflectable metal or plastic links 47 which are secured to each other at their adjacent ends by additional rivets 51 and backing grommets 51*a* to provide a chain like structure extending across the curtain 22 from one lateral side edge to the other. The stiffening means provided by the links 47 resists lateral deflection of the curtain 22 out of its normal plane P, FIG. 2, when the curtain is in a door closed position. However, if the bottom bar assembly 42 encounters an obstacle as the curtain 22 moves generally in plane P toward its closed position, the links 47 will pivot with respect to each other to allow the curtain to flex in a vertical direction or within plane P to accommodate the obstacle and prevent damage to the curtain or the obstacle. The links 47 are operable to pivot about the central axes of the respective pivot connections between each link as provided by the respective rivet and backing grommet assemblies 51, 51*a*. In this way the curtain 22 is operable to resist deflection due to air pressure differentials or so called windloads at its bottom edge while being capable of deflection in plane P. The interconnected links 47 are preferably disposed within outer envelope 48, as shown.

Figure 8:
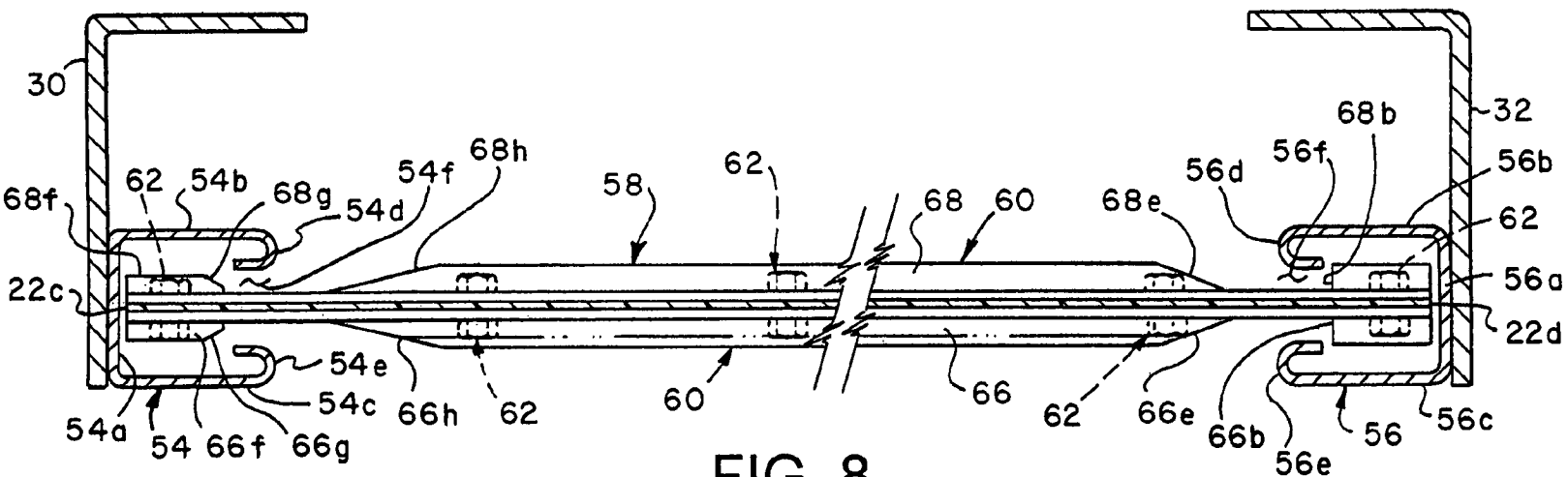
FIG. 8 is a detail section view taken generally along the line 2—2 but on a larger scale than the view of FIG. 2.

Referring now to FIGS. 1, 2 and 8, opposite side edges 22*c* and 22*d* of the curtain 22, FIG. 1, are guided for movement between the floor 28*a* and the roller or drum 24 by spaced apart somewhat channel shaped guide tracks 54 and 56, FIG. 8, which are suitably secured, respectively, to the members 30 and 32. The guide tracks 54 and 56 may be identical and are preferably formed-as folded, roll formed or extruded metal members. By way of example, as shown in FIG. 8, the guide track 54 includes a web 54*a* and opposed flanges 54*b* and 54*c* which are provided with curved reentrant distal ends 54*d* and 54*e* forming respective hooks or the like and providing a reduced width slot 54*f*. The guide track 56 includes corresponding substantially identical features which are identified by numerals 56*a* through 56*f*.

Figure 7:
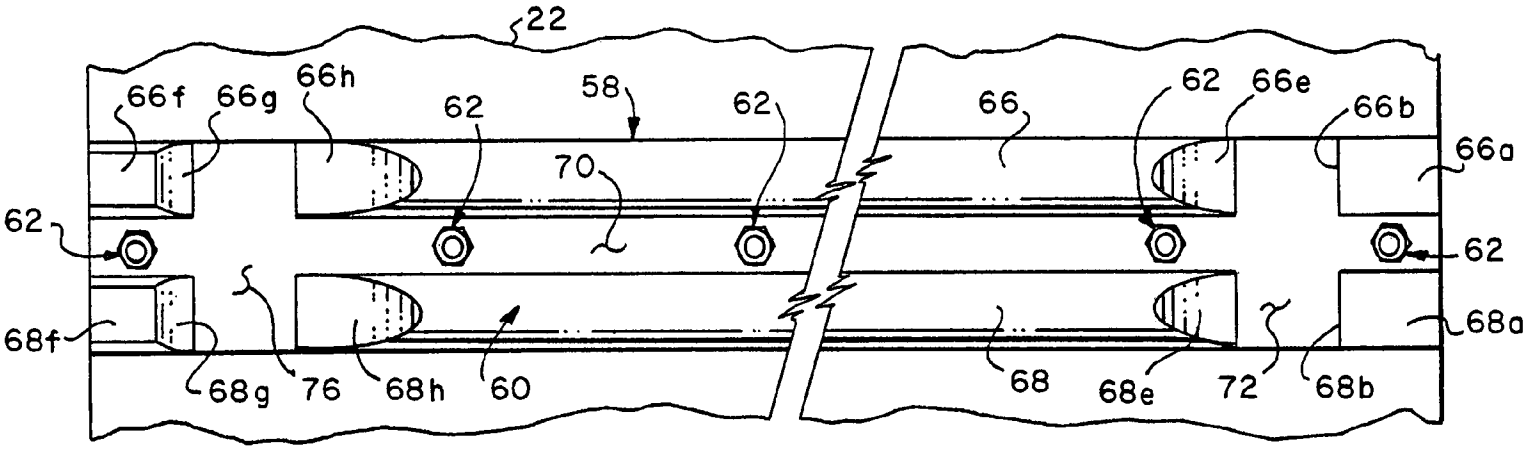
FIG. 7 is a side elevation of one preferred embodiment of a combination strut and associated windlock members of the present invention.

The slots 54*f* and 56*f* are operable for receiving the curtain 22 as well as opposite ends of plural spaced apart elastically bendable combination curtain stiffening struts and windlock members 58, see FIGS. 1 and 8. The respective strut and windlock members 58 are characterized by oppositely facing combination strut and windlock parts 60, FIG. 8, which are secured to each other from opposite sides of the curtain 22, with the curtain disposed therebetween, by suitable spaced apart threaded fastener assemblies 62, as shown in FIGS. 7 and 8. In one embodiment of the invention each of the combination strut and windlock parts 60 comprises an elongated member, preferably integrally formed of glass fiber reinforced plastic and having a substantially planar surface 64 on one side thereof, FIG. 10. Opposed elongated bosses 66 and 68 are formed and disposed on opposite sides of a recessed portion 70, see FIG. 7 also. The bosses 66 and 68 are also intersected adjacent one end by a transverse recess 72 which also intersects the recess 70 to provide short boss portions 66*a* and 68*a*, FIG. 7. Boss portions 66*a* and 68a form surfaces 66*b* and 68*b* which are coplanar and extend normal to the surfaces 64, respectively, of the opposed strut and windlock parts 60. As also shown in FIG. 8, the bosses 66 and 68 are relieved gradually at surfaces 66*e* and 68*e* to provide sufficient clearance for the guide track distal ends 56*d* and 56*e* so as to not interfere with the normal movement of the curtain 22 as it moves between open and closed positions guided by the guide tracks 54 and 56.

Figure 9:
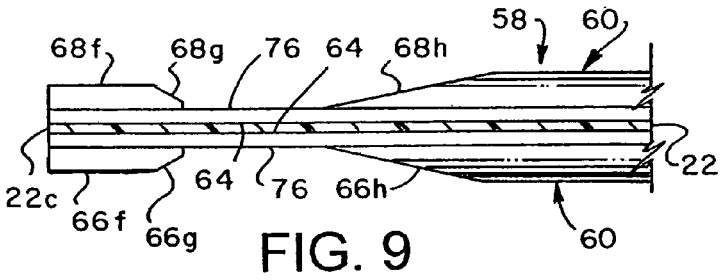
FIG. 9 is a detail view of one end of a combination strut and windlock member showing a configuration which permits release of the windlock portion of the strut from its guide track.

Referring further to FIGS. 7, 8, and 9, the opposite end of the each of the strut and windlock parts 60 is also provided with a transverse recess 76 leaving short projections or boss portions 66*f* and 68*f*, respectively. As shown in FIGS. 7 and 9, the boss portions 66*f* and 68f are also delimited by surfaces 66*g* and 68*g* which are inclined at an angle of about thirty degrees to the surfaces 64, respectively. The bosses 66 and 68 are also relieved at sloping surfaces 66*h* and 68*h* to provide clearance for the hook-like flange distal ends 54*d* and 54*e* of the guide track 54, as shown in FIG. 8.

The configuration of the combination curtain stiffening strut and windlock members 58 is advantageous. In situations where the door curtain 22, in the closed position, is impacted by a vehicle, such as a freight truck, or is subject to extreme windloads, the curtain 22 will be relieved to prevent damage thereto or to the guide tracks 54 and 56 by allowing the curtain side edge 22*c* to pull out of the channel formed by the guide track 54 through the slot 54*f* formed between the flange distal ends 54*d* and 54*e*. However, the opposite side edge 22*d* of the curtain 22 will remain in the channel formed by the guide track 56. In this way the forces acting on the curtain may be relieved without damaging the curtain 22 while at the same time the curtain is not entirely released from engagement with the door frame formed by the guide tracks and the frame members 30 and 32.

Figure 11:
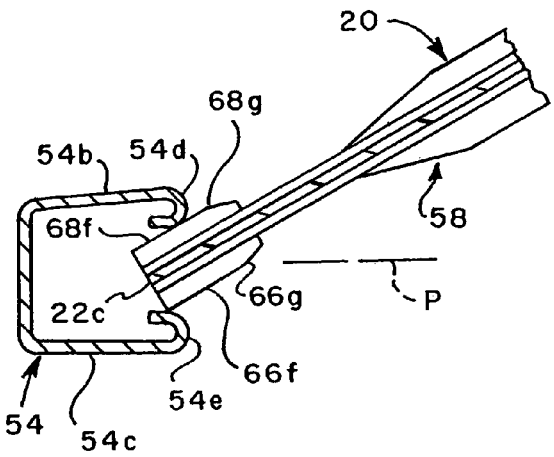
FIG. 11 is a detail view showing how the combination strut and windlock member of the embodiment of FIGS. 7 through 9 are releasable from their associated guide track at one side of the door curtain.
Figure 12:
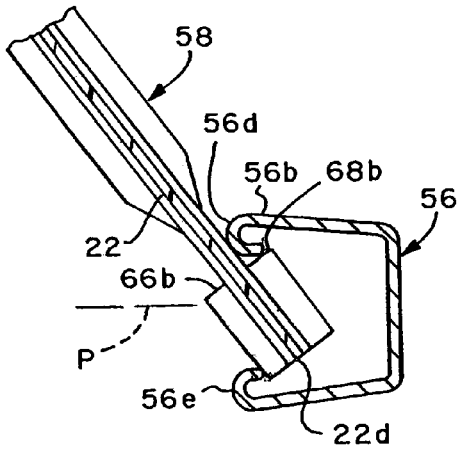
FIG. 12 is a detail view showing how the combination strut and windlock members of the embodiment of FIGS. 7 through 9 are retained in the opposite guide track even when substantially deflected.

Referring to FIGS. 11 and 12, there is illustrated the cooperation between the guide tracks 54 and 56 and the respective opposite ends of the combination strut and windlock members 58 under substantial deflection of the strut and windlock members as a consequence of occurrences of the type described above. As shown in FIG. 11, thanks to the configuration of the boss portions 66*f* and 68*f*, including the sloped or inclined surfaces 68*g* and 66*g* of the respective strut members 58, in response to deflection of the curtain 22 and the strut members of about thirty degrees from the plane P of an undeflected curtain, the flanges 54*b* and 54*c* of guide track 54 will elastically deflect to allow the ends of the strut members 58 which include the boss portions 66*f* and 68*f* to escape from the guide track to prevent damage to the curtain or to the combination strut and windlock members. Forces acting on the curtain 22 and the combination strut and windlock members 58 causing deflection of same somewhat less than about thirty degrees will not result in the strut and windlock members exiting the guide track 54.

Moreover, as shown in FIG. 12, elastic deflection of the strut and windlock members 58 and the curtain 22 in a range of up to and exceeding about thirty-five to forty degrees will not result in the opposite end of each strut and windlock member exiting the guide track 56, thanks to the configuration of the surfaces 66*b* and 68*b* and engagement thereof with the reentrant or hook-like flange distal ends 56*d* and/or 56*e*. Accordingly, by configuring the strut and windlock members 58 as described above, the curtain edge 22*c* may exit the guide track 54 while the curtain edge 22*d* remains in the channel shaped slot of the guide track 56. In this way the door assembly 20 may be subjected to impacts from various objects or subjected to severe air pressure differentials or "windloads" from either side of the door curtain 22 while reacting to relieve the forces causing such deflection without resulting in the curtain being completely disengaged from the guide structure provided by the tracks 54 and 56.

Figure 6:
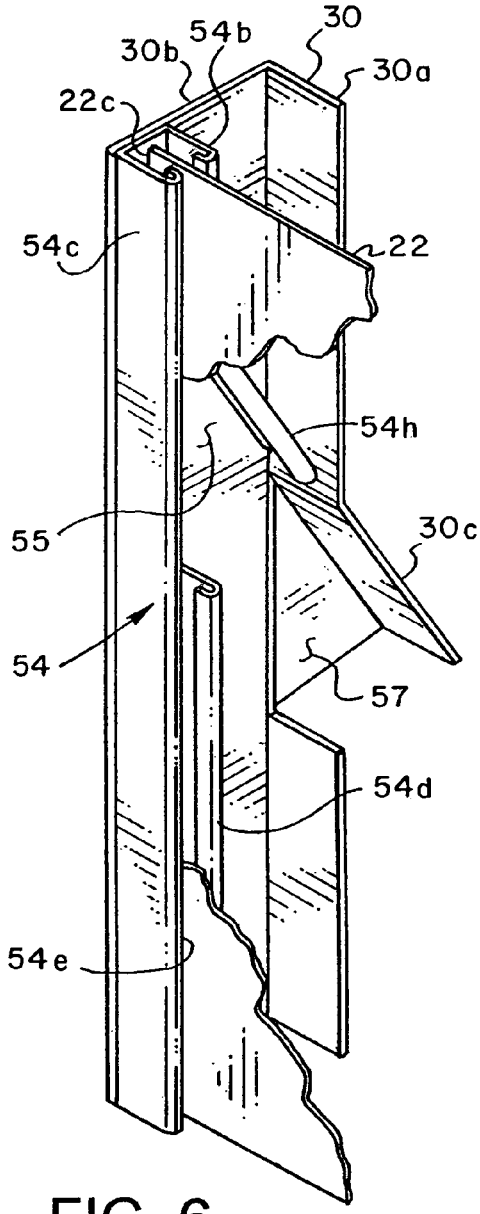
FIG. 6 is a detail view showing one preferred embodiment of a device for recapturing one end of respective combination struts and windlocks within the guide track for the door assembly of the present invention.

Referring now to FIG. 6, in order for the strut and windlock members 58 to be reinserted in the guide track 54 with the door 20 in the closed position, that is with the curtain 22 substantially unrolled from drum 24, the drive-motor unit 38 is operated to begin raising the curtain by rotating the roller or drum 24 to wind the curtain thereon. As shown in FIG. 6, the guide track 54 is provided with a recapture slot 55, preferably formed by bending a portion of the flange 54*b* away from the flange 54*c* as shown at 54*h* to create the recapture slot 55 and provide a guide surface for recapturing within the guide track the ends of respective strut members 58 which have exited therefrom. This action will occur as the curtain 22 is reeled onto the drum 24. In this regard the flange portion 54*h* is formed on the guide track 54 near the upper end thereof, as indicated in FIGS. 3 and 6. As further shown in FIG. 6, in the arrangement where the angle frame member 30 is used to support the guide track 54 and is provided with opposed flanges 30*a* and 30*b*, the flange 30*a* is cut away and deflected to form a guide surface 30*c* and a recapture slot 57. The guide surfaces 54*h* and 30*c* are suitably aligned to allow the ends of the strut and windlock members 58, which include the boss portions 66*f* and 68*f*, to move through the slots 57 and 55 to be recaptured within the track 54. In the arrangement of FIG. 6 it is anticipated that the curtain edge 22*c* will need to be reinserted from only one side of the doorway 26, hence the provision of a single slot 55 and guide surface 54*h*. However, a part of track flange 54*c* may also be configured to form a guide for recapture of the curtain edge 22*c* and strut end portions if the curtain 22 was forced to exit the guide track 54 in the opposite direction.

Figure 10:
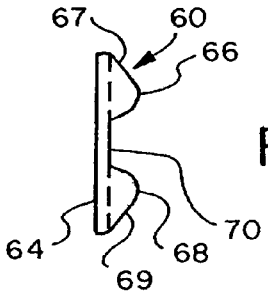
FIG. 10 is an end view of the combination strut and windlock parts shown in FIGS. 7 through 9 illustrating the profile thereof.

Referring briefly to FIG. 10, a cross section of the configuration of the main portions of the bosses 66 and 68 is illustrated wherein surfaces 67 and 69 on the respective bosses are inclined in opposite directions with respect to each other and the planar surface 64 and are operable to eliminate any sharp edges which may form a wear point as the strut and windlock members 58 are wound onto the drum 24 along with the curtain 22. The inclined surfaces 67 and 69 also reduce the cross sectional thickness of the bosses 66 and 68 sufficiently to minimize any bulging effect of the strut and windlock members 58 as they are rolled onto and off of the drum 24. As shown in FIG. 3, the drum 24 is generally aligned tangentially with the upper ends of the guide tracks 54 and 56 to facilitate rolling the curtain 22 onto and off of the drum.

The construction and operation of the door assembly 20 is believed to be readily understandable from the foregoing description. However, briefly, the curtain 22 is guided for movement between open and closed positions by the guide tracks 54 and 56 since the opposite ends of the strut and windlock members 58 slide freely in the slots 54*f* and 56*f* formed by the guide track members. The weighted soft bottom bar assembly 42 facilitates maintaining proper tension in the curtain 22 as it is moved between door open and door closed positions and conforms readily to any obstruction which may intrude into the doorway 26 when the door curtain is being moved toward a closed position. The specific configuration of the bottom bar assembly 42 and the curtain stiffening links 47 are advantageous, as pointed out hereinabove.

Of course, if a vehicle or other object impacts the curtain 22 in its closed position or the curtain is subjected to substantial windloads, the strut and windlock members 58, together with the curtain, will elastically deflect substantially until the strut and windlock members are deflected to the degree indicated in FIG. 11, at which time the ends of the strut and windlock members will exit the guide track 54 to relieve the forces acting thereon. The strut and windlock members 58 may then be recaptured by rotating the drum 24 to reel the curtain 22 thereon at least until the strut and windlock members 58 which have exited the track 54, and also have possibly been deflected past the flange 30*a*, are recaptured.

Figure 13:
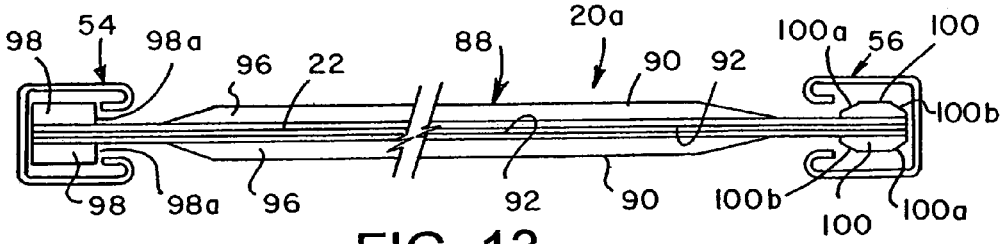
FIG. 13 is a plan view of an alternate embodiment of a combination stiffening strut and windlocks in accordance with the present invention.
Figure 14:
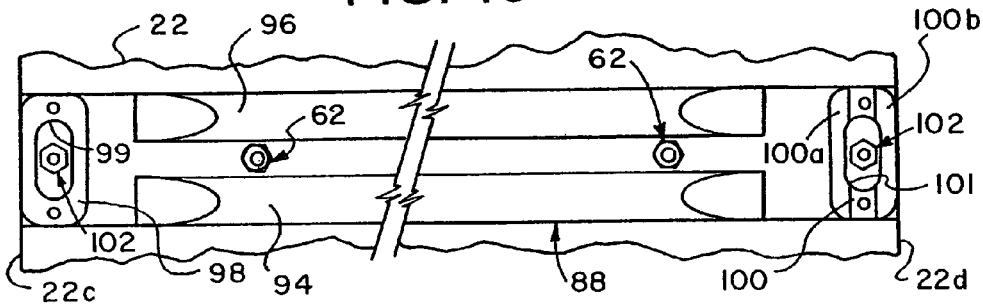
FIG. 14 is a side elevation of the strut shown in FIG. 13.

Referring now to FIGS. 13, 14, 15 and 16, portions of a modified door assembly 20*a* in accordance with the invention are illustrated. The door assembly 20*a* is substantially like the door assembly 20 except for the features described hereinbelow. As shown in FIGS. 13 and 14, the door assembly 20*a* includes one or more combination strut and windlock members 88 made up of opposed strut parts 90 which are each provided with a planar surface 92 and between which is sandwiched the curtain 22. The strut parts 90 are secured together with the curtain 22 disposed therebetween by suitable fastener assemblies 62, as shown in FIG. 14. The strut parts 90 may also be formed of elastically bendable glass fiber reinforced plastic and include longitudinally extending spaced apart boss portions 94 and 96 similar to the boss portions 66 and 68 of the strut parts 60.

Figure 15:
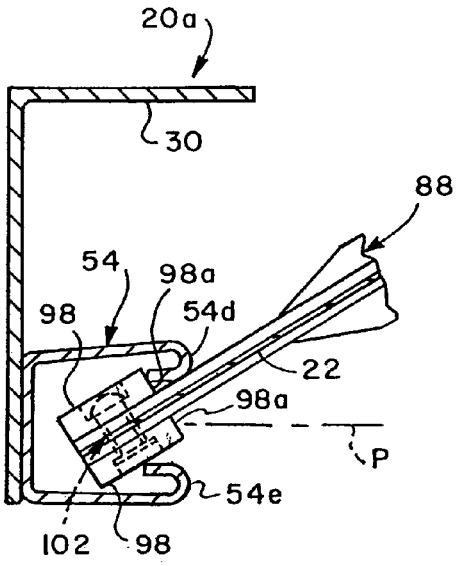
FIG. 15 is a detail section view showing one end of the strut of FIGS. 13 and 14 deflected but retained in the guide track.

The strut parts 90 are each provided with separate windlock projections or boss parts 98 and 100, similar in some respect to the boss portions 66*a*, 68*a* and 66*f*, 68*f* of the strut members 58. The windlock boss parts 98 and 100 are formed as separate members, preferably of a wear resistant, somewhat self lubricating plastic, such as Nylon, and are secured to the assembly forming the strut member 88 by suitable threaded fastener assemblies 102, respectively, see FIGS. 15 and 16 also. The fastener assemblies 102 are disposed in suitable recesses 99 and 101, see FIG. 14, of the respective windlock boss parts 98 and 100. As further shown in FIGS. 13, 14, and 15, each of the boss parts 98 includes a planar surface 98*a* formed thereon extending generally normal to the surface 92 and adapted to engage the reentrant edge or flange end portions 54*d* or 54*e* of the guide track 54, for example, to prevent the end of the strut member 88 disposed in the guide track 54 from exiting the track, as shown in FIG. 15, in particular. With respect to the door assembly 20*a*, the assembly has been modified such that the side edge 22*c* of curtain 22 will be retained in guide track 54 while the curtain side edge 22*d* and the combination strut and windlock members 88 may exit from the guide track 56, as will be explained in further detail herein.

Figure 16:
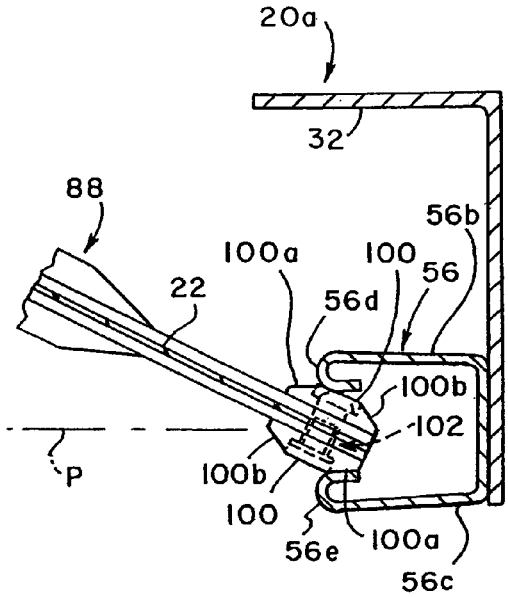
FIG. 16 is a detail section view of the opposite end of the strut shown in FIGS. 13 and 14 being pulled out of its guide track at a certain amount of deflection.

Referring further to FIGS. 13, 14 and 16, the windlock boss parts 100 are provided with opposed inclined surfaces 100*a* and 100*b*, as shown in the drawing figures, which surfaces are inclined with respect to the surface 92 in such a way that the surfaces 100*a* or 100*b* will engage the reentrant distal edge or flange end portions 56*d* or 56*e* of guide track 56 to deflect or spread the guide track flanges 56*b* and 56*c* sufficiently to allow the curtain side edge 22*d* and the strut member 88 to exit the guide track 56, as shown in FIG. 16. Accordingly, by providing inclined surfaces 100*a* and 100*b* on each of the windlock boss parts 100, the end of the strut member 88 which includes the windlock boss parts 100 may exit the guide track 56 smoothly without undue stress on the windlock boss parts which would tend to damage these parts and/or the guide track 56. However, as with the door assembly 20, the combination strut and windlock members 88 will not exit the guide track 56 until these strut members undergo substantially the amount of deflection from the plane P as previously described.

Figure 17:
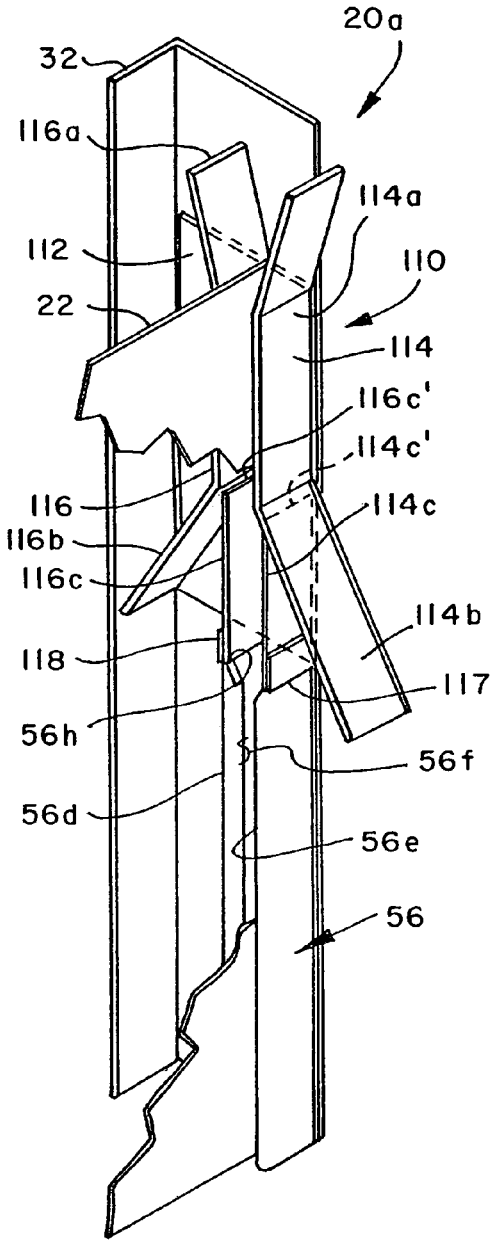
FIG. 17 is a perspective view of an alternate embodiment of a curtain side edge and strut recapture device.

Referring now to FIG. 17, a modified curtain and strut recapture arrangement is provided for the door assembly 20*a*, as shown. For example, the guide track 56 may be shortened somewhat from the arrangement shown in FIGS. 1 and 3 to provide for disposition of a curtain side edge recapture assembly 110. A curtain side edge recapture assembly 110 is shown mounted adjacent and directly above a top edge 56h of guide track 56 and suitably secured to the support member 32. The curtain recapture assembly 110 includes a generally flat plate support member 112 adapted to be suitably secured to the support member 32 by fasteners, not shown in FIG. 17. The support member 112 supports opposed guide flanges 114 and 116 which are mirror image parts and include opposed outwardly diverging upper guide portions 114*a* and 116*a* for guiding the curtain 22 as it is reeled onto and off of a support drum or roller 24, also not shown in FIG. 17.

The guide flange members 114 and 116 also include inclined flange parts 114*b* and 116*b* which extend downwardly and outwardly with respect to each other and with respect to the opposed flanges of the guide track 56 for guiding the ends of the strut members 88 which include the windlock boss parts 100 back into the slot 56*f* of the guide track 56 if the curtain 22 should be pulled out of the guide track in the manner previously described. However, the curtain recapture assembly 110 also includes opposed elastically deflectable plate members 114*c* and 116*c* which are suitably secured at their lower ends to supports 117 and 118 each being connected to the support plate 112. The upper ends 114*c*' and 116*c*' of the guide members 114*c* and 116*c* are unsupported and the members 114*c* and 116*c* are operable to deflect inward, one toward the other, to allow the ends of the strut members 88 to be guided by the guide members 114b and 116*b* back into the guide track 56. The deflectable guide members 114*c* and 116*c* are, however, normally operable to be in their positions as shown in FIG. 17 to guide the curtain edge 22*d* and the strut members 88 within the guide track slot 56*f* during normal operation of the door assembly 20*a*. A mirror image part of the recapture assembly 110 may be provided on the opposite side of the door assembly 20*a* if the curtain 22 is to be allowed to exit the guide track 54 instead of the guide track 56.

Figure 18:
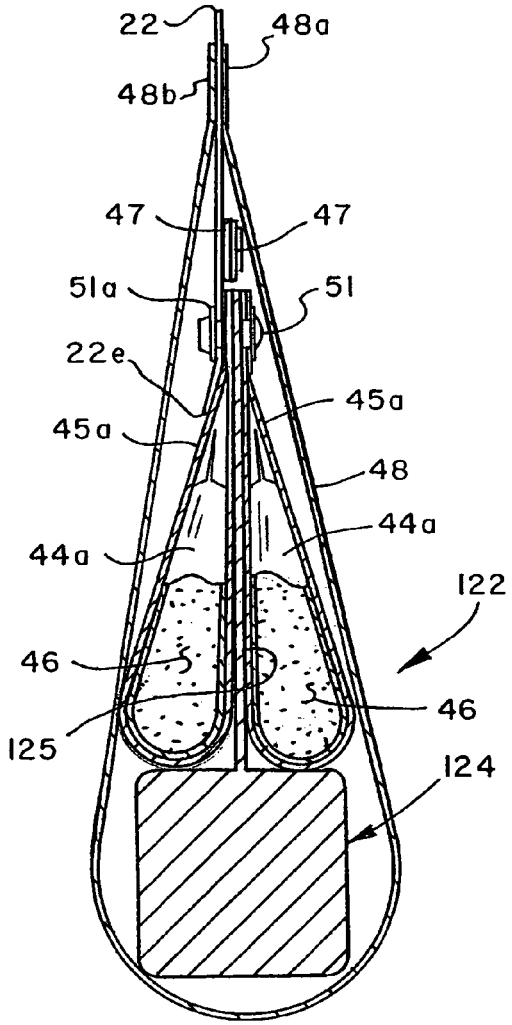
FIG. 18 is a detail section view taken from the line 18—18 of FIG. 19.
Figure 19:
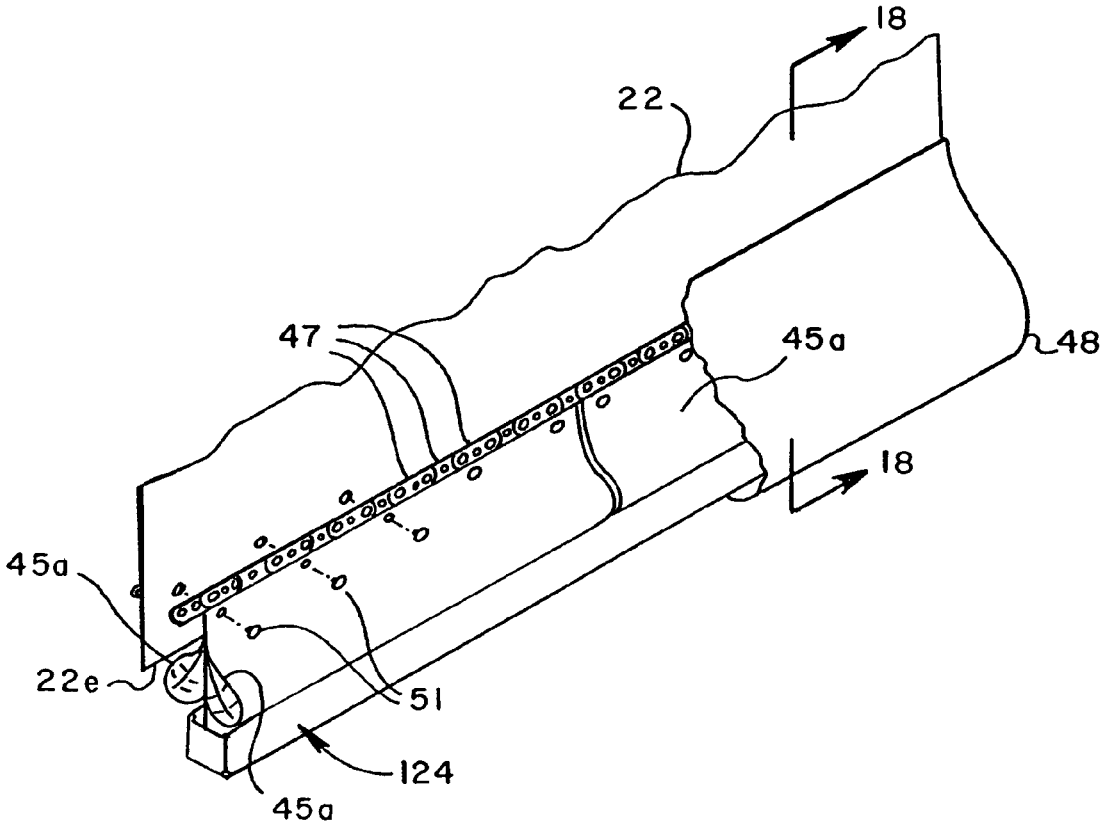
FIG. 19 is a perspective view of an alternate embodiment of a bottom bar assembly for a flexible curtain rollup door in accordance with the invention.

Referring now to FIGS. 18 and 19, an alternate embodiment of a soft bottom bar assembly is illustrated and generally designated by numeral 122. Bottom bar assembly 122 includes a flexible outer envelope 48 secured to a curtain 22 in the same manner as for the embodiment illustrated in FIGS. 5A and 5B. However, the bottom bar assembly 122 also includes an elongated, somewhat flexible obstruction detector 124 which may be of a type commercially available, such as from Miller Edge, Inc. of Jennersville, Pa. As shown in FIGS. 18 and 19, the bottom bar assembly 122 further includes plural weight members comprising flexible bags 44a, similar to the bags 44, and disposed within respective inner envelope members 45*a* generally in the same manner that the bags 44 are supported in and by the envelope members 45. The bags 44*a* are disposed on opposite sides of a web part 125 of the obstruction detector member 124 and contain suitable quantities of particulate material 46, respectively. The envelopes 45*a* and the web 125 of the obstruction detector 124 are secured by rivet assemblies 51, 51*a* to the curtain 22 adjacent its bottom edge 22*e* as shown in FIGS. 18 and 19.

The outer envelope 48 encapsulates or covers the aforementioned combination of the obstruction detector 124 and the bag and inner envelope assemblies 44*a*, 45*a*. Still further, as shown in FIG. 19, the curtain 22, for the arrangement of a bottom bar assembly 122, may also be stiffened against lateral deflection out of its plane P by the stiffening means formed by the interconnected links 47 in the same manner as described hereinabove.

In addition to the materials and items specified herein, conventional engineering materials may be used for constructing the door assemblies 20 and 20*a*. The fabrication thereof is believed to be readily achievable by those skilled in the art based on the foregoing description and a further detailed description is not believed to be necessary to practice the invention.

Although preferred embodiments of a rollup door assembly in accordance with the invention have been described in detail hereinbefore, those skilled in the art will recognize that various substitutions and modifications may be made to the invention without departing from the scope and spirit of the appended claims,.

What is claimed is:

1. A motorized door comprising:

a flexible curtain closure member having a transverse bottom edge and opposed side edges;

spaced apart guide tracks for guiding said side edges of said closure member for movement between open and closed positions, at least one of said guide tracks comprising a channel shaped member having a web and opposed flanges, said flanges including reentrant distal ends providing a reduced width slot between said flanges for receiving one of said side edges of said closure member;

opposed windlock members supported on said closure member at said side edges thereof, respectively, for movement within said guide tracks for retaining said side edges of said closure member in said guide tracks, said windlock members on said one side edge being configured for engagement with said distal ends of said flanges while said windlock members on the other of said side edges are operable to exit said other guide track in response to a predetermined force acting on said closure member; and curtain stiffening means secured to said closure member adjacent said bottom edge for stiffening said closure member against deflection in a direction out of a plane in which said closure member is disposed in a door closed position of said closure member while allowing deflection of said closure member substantially vertically and within said plane of said closure member, said stiffening means comprising plural interconnected links extending across said closure member from said one side edge toward said other side edge and adjacent said bottom edge, said links being secured to said closure member and to each other, respectively.

2. The door set forth in claim 1 wherein:

said links are pivotally connected to each other by fasteners for securing said stiffening means to said curtain and operable to allow pivotal movement of said links with respect to each other in said plane of said closure member in response to said bottom edge of said closure member engaging an obstacle.

3. A motorized door comprising:

a flexible curtain closure member having a transverse bottom edge and opposed side edges;

spaced apart guide tracks for guiding said side edges of said closure member for movement between open and closed positions; and curtain stiffening means secured to said closure member adjacent said bottom edge for stiffening said closure member against deflection in a direction out of a plane in which said closure member is disposed in a door closed position of said closure member while allowing deflection of said closure member substantially vertically and within said plane of said closure member, said stiffening means comprising plural interconnected links extending across said closure member from one side edge toward the other side edge and adjacent said bottom edge, said links being secured to said closure member and said links are pivotally connected to each other, respectively, by fasteners for securing said stiffening means to said closure member and operable to allow pivotal movement of said links with respect to each other in said plane of said closure member in response to said bottom edge of said closure member engaging an obstacle.

4. A motorized door comprising:

a flexible curtain closure member having a transverse bottom edge and opposed side edges;

spaced apart guide tracks for guiding said side edges of said closure member for movement between open and closed positions;

curtain stiffening means secured to said closure member adjacent said bottom edge for stiffening said closure member against deflection in a direction out of a plane in which said closure member is disposed in a door closed position of said closure member while allowing deflection of said closure member substantially vertically and within said plane of said closure member; and a plurality of flexible bags containing dense material, respectively, and secured to said closure member adjacent said bottom edge, substantially side by side across said bottom edge.

5. The door set forth in claim 4 wherein:

said bags are at least partially filled with particulate material selected from a group consisting of steel shot, welding slag, sand and dense particulate material.

6. The door set forth in claim 4 including:

a flexible outer envelope disposed over said bags.

7. The door set forth in claim 4 including:

an obstruction detector secured to said closure member at said bottom edge and adjacent said bags.

8. A motorized door comprising:

a flexible curtain closure member having a transverse bottom edge and opposed side edges;

spaced apart guide tracks for guiding said side edges of said closure member for movement between open and closed positions;

curtain stiffening means secured to said closure member adjacent said bottom edge for stiffening said closure member against deflection in a direction out of a plane in which said closure member is disposed in a door closed position of said closure member while allowing deflection of said closure member substantially vertically and within said plane of said closure member; and opposed windlock members supported on said closure member at said side edges, respectively, for movement within said guide tracks for retaining said side edges of said closure member in said guide tracks, at least said windlock members on one side edge being configured for engagement with one of said guide tracks for retaining said one side edge in said one guide track while said windlock members on the other of said side edges are operable to exit the other guide track in response to a predetermined force acting on said closure member.

9. The door set forth in claim 8 wherein:

said windlock members are disposed on opposite ends of respective elongated struts secured to said closure member.

10. The door set forth in claim 9 wherein:

said windlock members are formed as separate parts and are removably secured to said struts by mechanical fasteners, respectively.

11. A motorized door comprising:

a flexible curtain closure member having a transverse bottom edge and opposed side edges;

spaced apart guide tracks for guiding said side edges of said closure member for movement between open and closed positions, at least one of said guide tracks comprising a channel shaped member having a web and opposed flanges, said flanges including reentrant distal ends providing a reduced width slot between said flanges for receiving one of said side edges of said closure member;

opposed windlock members supported on said closure member at said side edges thereof, respectively, for movement within said guide tracks for retaining said side edges of said closure member in said guide tracks, at least said windlock members on said one side edge being configured for engagement with said distal ends of said flanges while said windlock members on the other of said side edges are operable to exit said other guide track in response to a predetermined force acting on said closure member; and a plurality of flexible bags containing dense material, respectively, and secured to said curtain adjacent said bottom edge, substantially side by side across said bottom edge.

12. The door set forth in claim 11 wherein:

said bags are at least partially filled with particulate material selected from a group consisting of steel shot, welding slag, sand and dense particulate material.

13. The door set forth in claim 11 including:

a flexible outer envelope disposed over said bags.

14. The door set forth in claim 11 including:

an obstruction detector secured to said curtain at said bottom edge and adjacent said bags.

* * * * *